US010919055B2

(12) United States Patent
Park et al.

(10) Patent No.: US 10,919,055 B2
(45) Date of Patent: Feb. 16, 2021

(54) DOUBLE BELL CUP

(71) Applicant: Sang Eun Park, Hwaseong-si (KR)

(72) Inventors: Sang Eun Park, Hwaseong-si (KR); Jung Sug Nam, Hwaseong-si (KR)

(73) Assignee: SANG EUN PARK, Hwaseong-si (KR)

( * ) Notice: Subject to any disclaimer, the term of this patent is extended or adjusted under 35 U.S.C. 154(b) by 18 days.

(21) Appl. No.: 16/071,642

(22) PCT Filed: Nov. 11, 2016

(86) PCT No.: PCT/KR2016/012958
§ 371 (c)(1),
(2) Date: Jul. 20, 2018

(87) PCT Pub. No.: WO2017/126792
PCT Pub. Date: Jul. 27, 2017

(65) Prior Publication Data

US 2019/0030548 A1 Jan. 31, 2019

(30) Foreign Application Priority Data

Jan. 20, 2016 (KR) ..... 10-2016-0007118

(51) Int. Cl.
*B05B 1/06* (2006.01)
*B05B 3/10* (2006.01)
(Continued)

(52) U.S. Cl.
CPC ..... *B05B 1/06* (2013.01); *B05B 3/1014* (2013.01); *B05B 3/1021* (2013.01);
(Continued)

(58) Field of Classification Search
CPC ..... B05B 1/06; B05B 3/1014; B05B 3/1021; B05B 3/1028; B05B 3/1064; B05B 5/0407; B05B 7/1431; B05B 7/1468
(Continued)

(56) References Cited

U.S. PATENT DOCUMENTS 2,711,926 A * 6/1955 Allander ..... B05B 3/1035 239/224
2,922,584 A * 1/1960 Slatkin ..... B05B 3/1064 239/245
(Continued)

FOREIGN PATENT DOCUMENTS

JP 2012152700 A 8/2012
JP 2013192979 A 9/2013
(Continued)

OTHER PUBLICATIONS

ISA Korean Intellectual Property Office, International Search Report Issued in Application No. PCT/KR2016/012958, dated Feb. 15, 2017, WIPO, 4 pages.

*Primary Examiner* — Joseph A Greenlund
(74) *Attorney, Agent, or Firm* — McCoy Russell LLP

(57) ABSTRACT

The present invention relates to a double bell cup installed on an end portion of a painting robot to centrifugally spray paint to an object to be painted, the double bell cup comprising: an outer body having a tapered structure that becomes gradually wider from the top to the bottom, wherein the outer body has an inlet passage formed on the top side thereof, a stagnation passage formed therein to communicate with the inlet passage, and a spray passage formed on the bottom side thereof to communicate with the stagnation passage, and paint is introduced through the inlet passage and retained in the stagnation passage; and an inner body having a tapered structure that becomes gradually wider from the top to the bottom.

9 Claims, 13 Drawing Sheets

(51) Int. Cl.
*B05B 7/14* (2006.01)
*B05B 5/04* (2006.01)

(52) U.S. Cl.
CPC ..... *B05B 3/1064* (2013.01); *B05B 5/0407* (2013.01); *B05B 7/1431* (2013.01); *B05B 7/1468* (2013.01)

(58) Field of Classification Search
USPC ..... 239/223
See application file for complete search history.

(56) References Cited

U.S. PATENT DOCUMENTS 4,148,932 A * 4/1979 Tada ..... B05B 5/0407 239/3
4,795,095 A * 1/1989 Shepard ..... B05B 3/105 239/214.17
5,897,060 A * 4/1999 Kon ..... B05B 5/0407 239/223
6,050,499 A * 4/2000 Takayama ..... B05B 3/1064 239/112
6,217,944 B1 * 4/2001 Yoshida ..... B05B 3/1014 427/401
6,230,994 B1 * 5/2001 Boerner ..... B05B 5/0407 239/700
6,341,734 B1 * 1/2002 Van Der Steur ..... B05B 3/1014 239/223
6,659,367 B2 * 12/2003 Ballu ..... B05B 15/18 239/223
7,726,586 B2 * 6/2010 Murai ..... B05B 3/1064 239/224
8,794,177 B2 * 8/2014 Shigekura ..... B05B 3/02 118/323
2002/0043576 A1 * 4/2002 Dion ..... B05B 5/0407 239/703
2003/0010840 A1 * 1/2003 Kon ..... B05B 5/0407 239/223
2003/0010841 A1 * 1/2003 Kon ..... B05B 3/1064 239/224
2008/0277496 A1 * 11/2008 Yasuda ..... B05B 5/0426 239/112
2009/0020626 A1 * 1/2009 Seitz ..... B05B 3/1092 239/332
2009/0255463 A1 * 10/2009 Seitz ..... B05B 3/1014 118/300
2010/0193602 A1 * 8/2010 Ballu ..... B05B 3/1064 239/224
2010/0193604 A1 * 8/2010 Ballu ..... B05B 5/0407 239/251
2010/0282865 A1 * 11/2010 Yamada ..... F16D 1/076 239/289
2010/0307408 A1 * 12/2010 Kishimoto ..... B05B 7/0408 118/300
2013/0153681 A1 * 6/2013 Mitsui ..... B05B 3/1014 239/225.1
2014/0166779 A1 * 6/2014 Yamauchi ..... B05B 5/0426 239/263
2016/0193616 A1 * 7/2016 Reichler ..... B05B 3/1057 239/224
2016/0339459 A1 * 11/2016 Kishimoto ..... B05B 3/1014
2018/0141061 A1 * 5/2018 Ito ..... B05B 5/0407
2018/0221896 A1 * 8/2018 Yamada ..... B05B 5/0533
2019/0083997 A1 * 3/2019 Kishimoto ..... B05B 3/1014
2019/0247872 A1 * 8/2019 Vetter ..... B05B 3/1014

FOREIGN PATENT DOCUMENTS

KR 100265890 B1 9/2000
KR 1020010033058 A 4/2001
KR 1020080082244 A 9/2008

* cited by examiner

【FIG. 1】
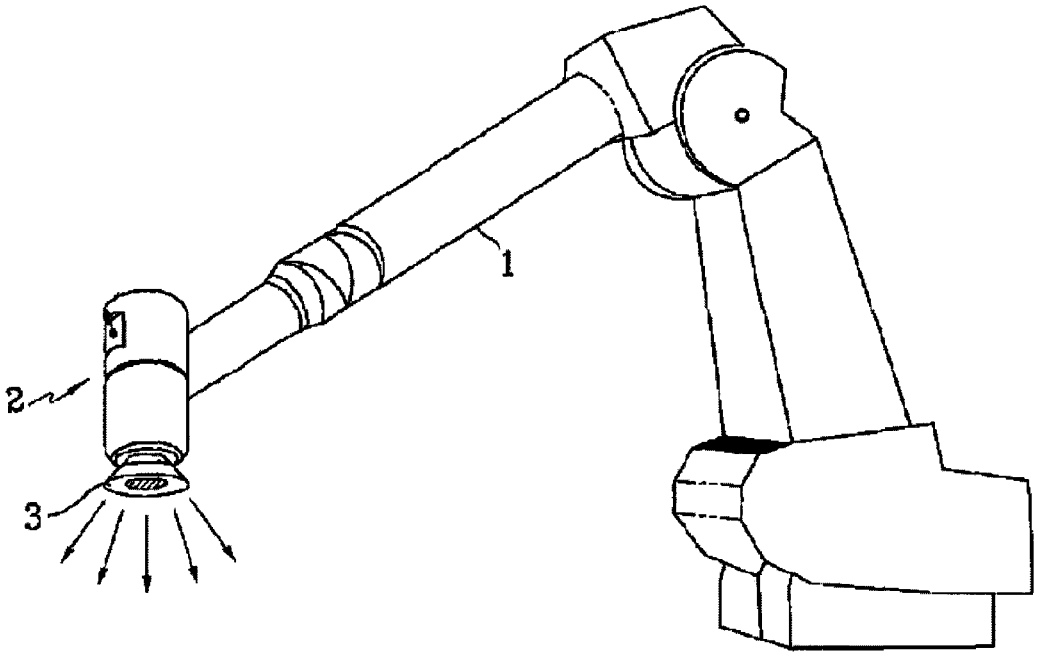
Prior Art

【FIG. 2】
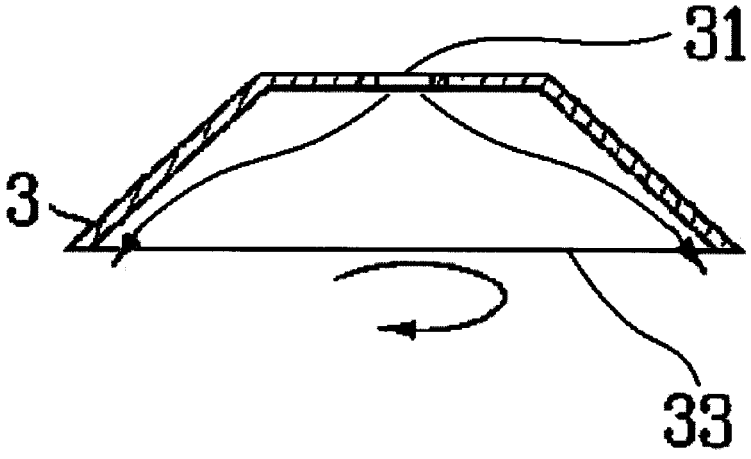
Prior Art

【FIG. 3】
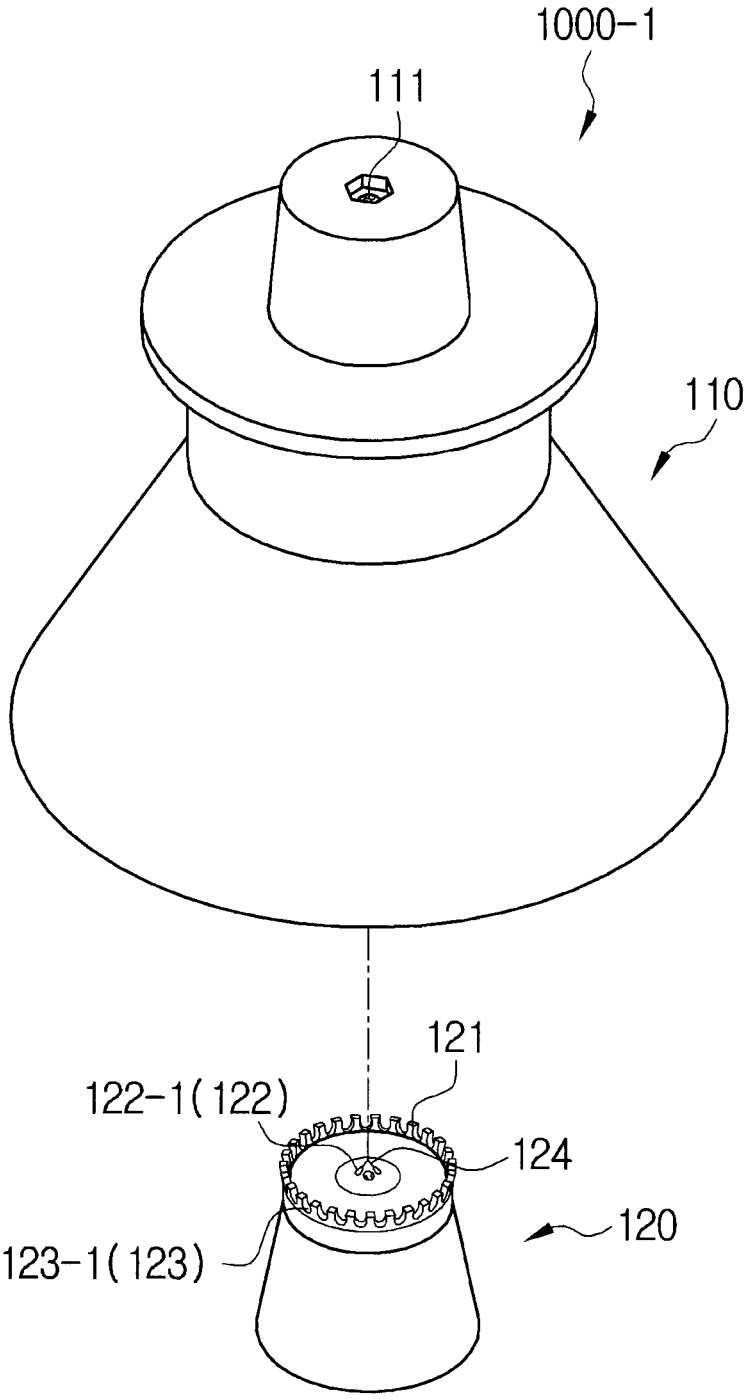

【FIG. 4A】
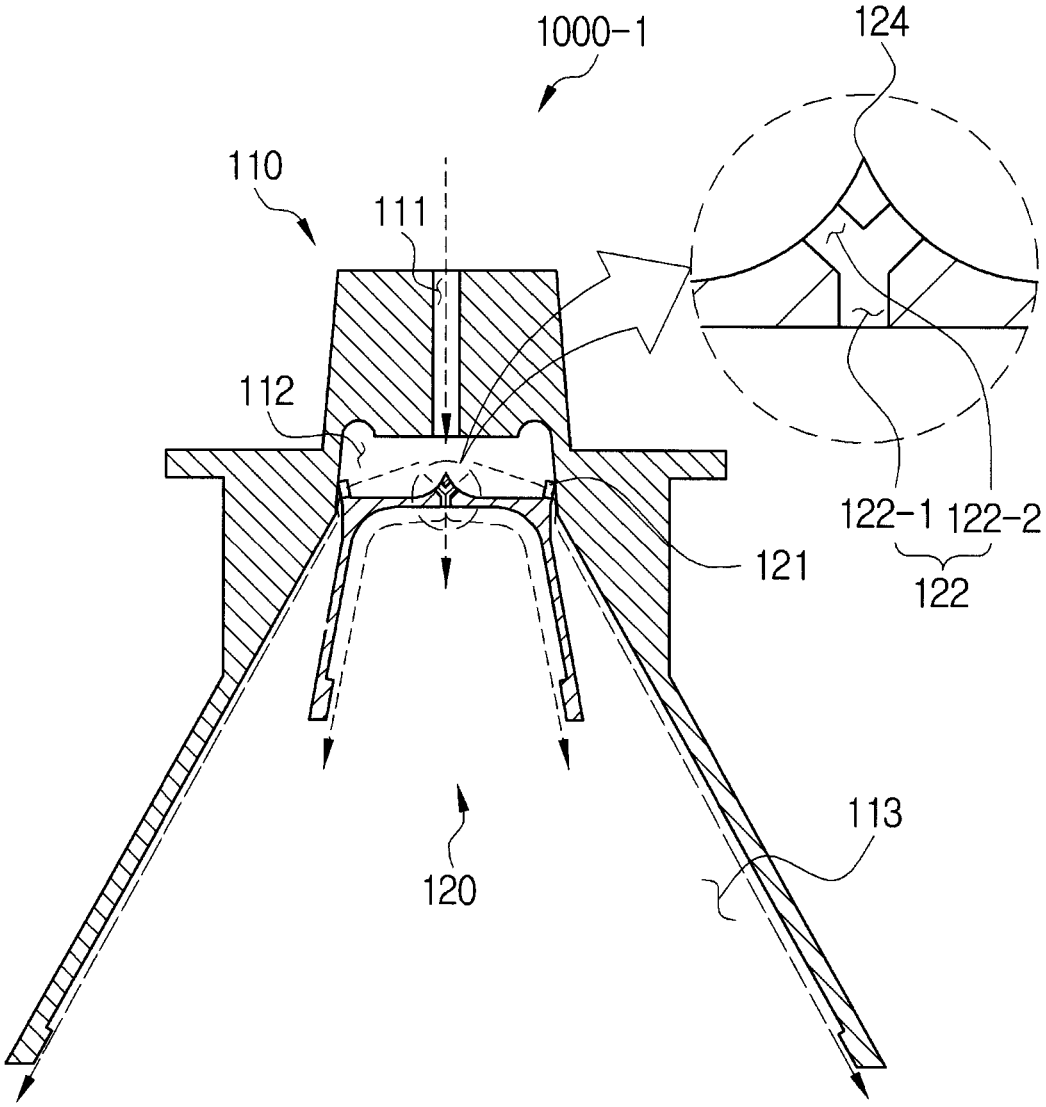

【FIG. 4B】
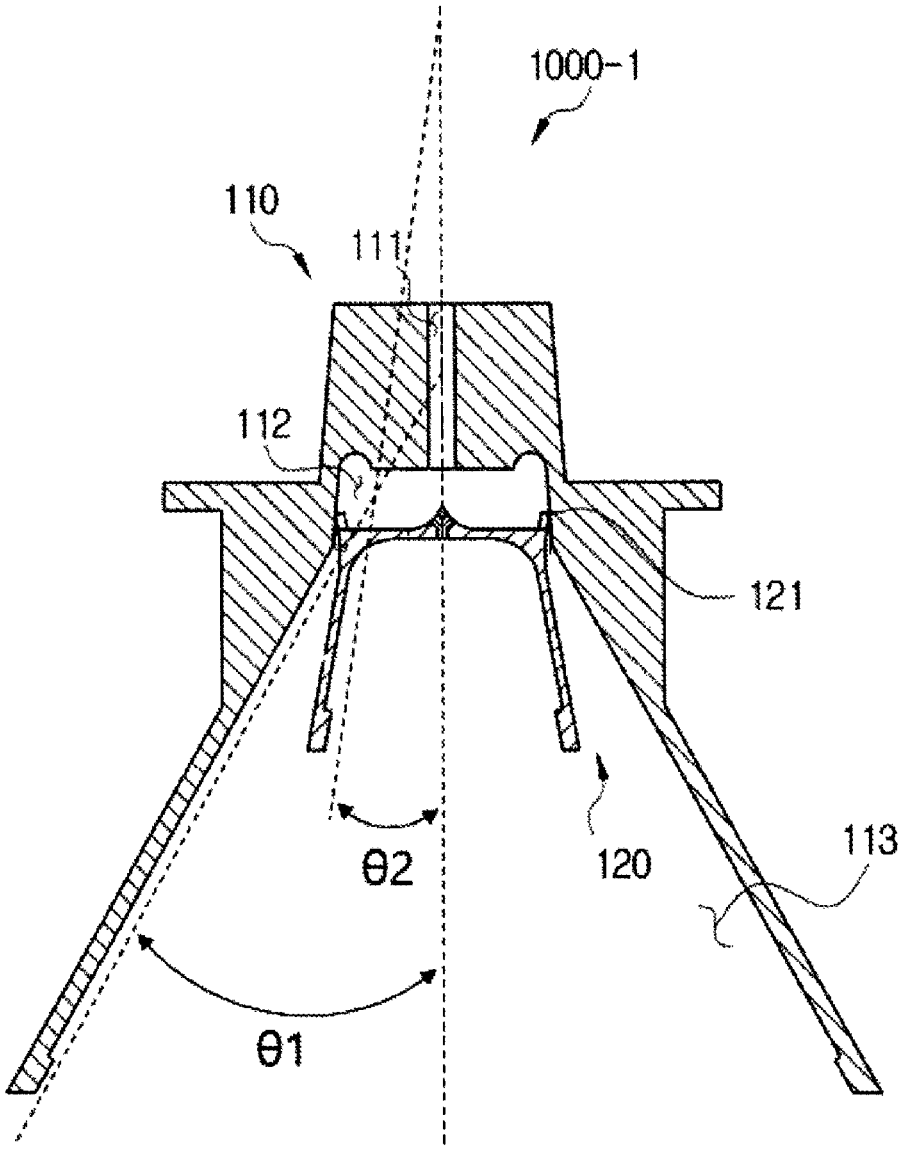

【FIG. 5】
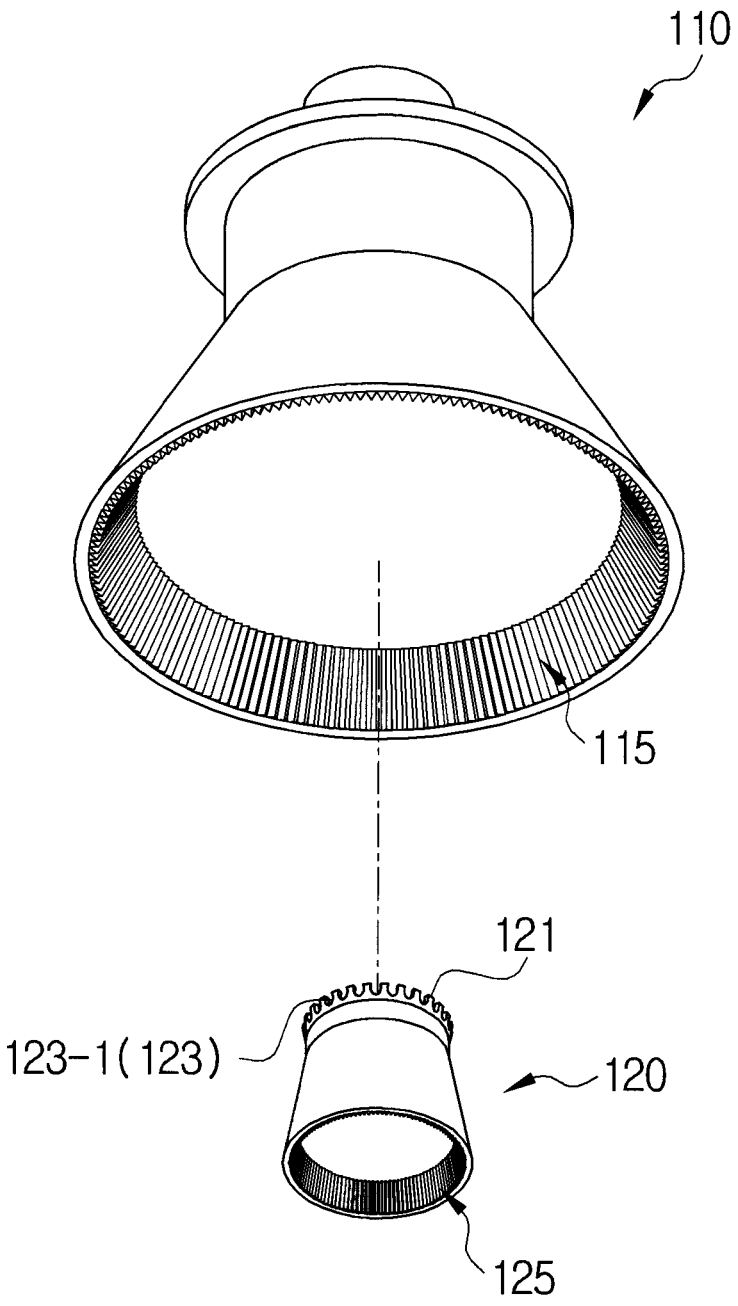

【FIG. 6】
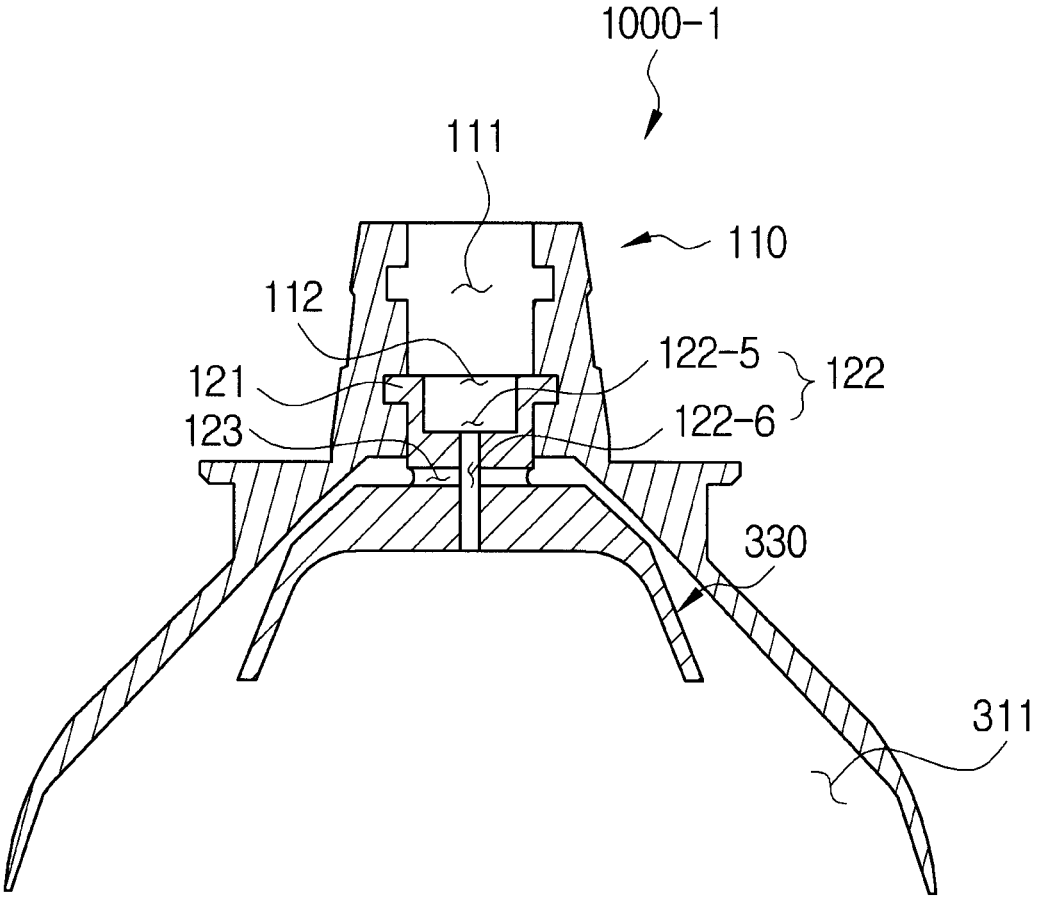

【FIG. 7A】
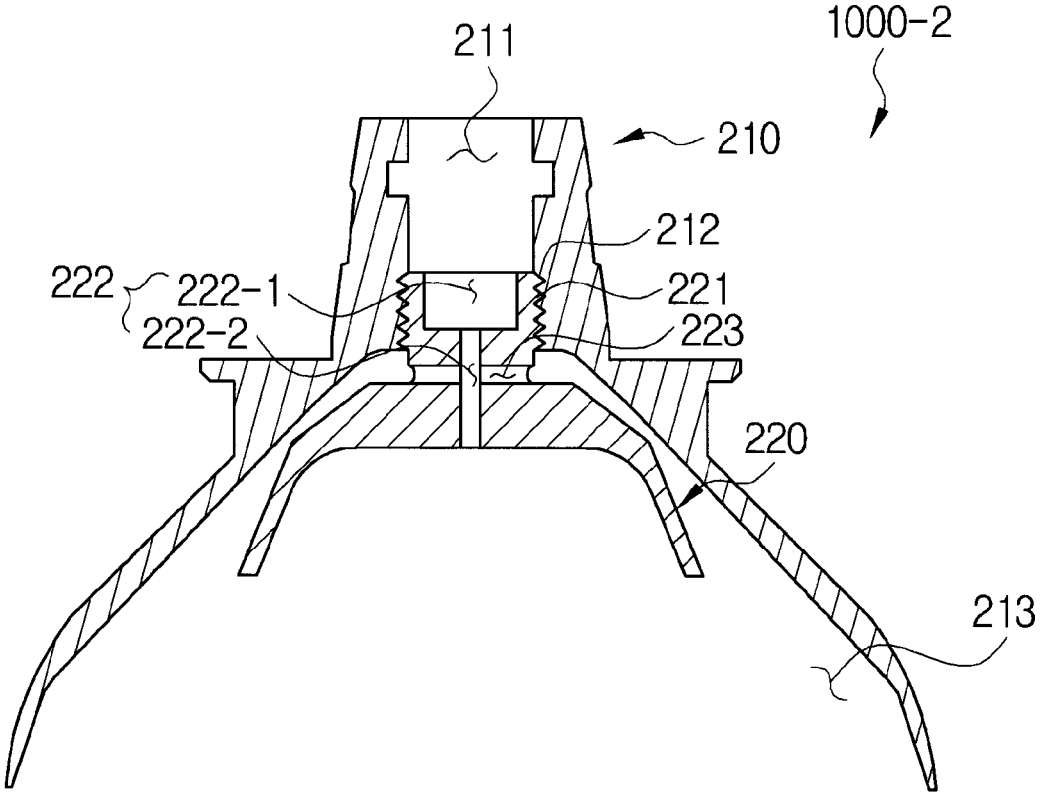

【FIG. 7B】
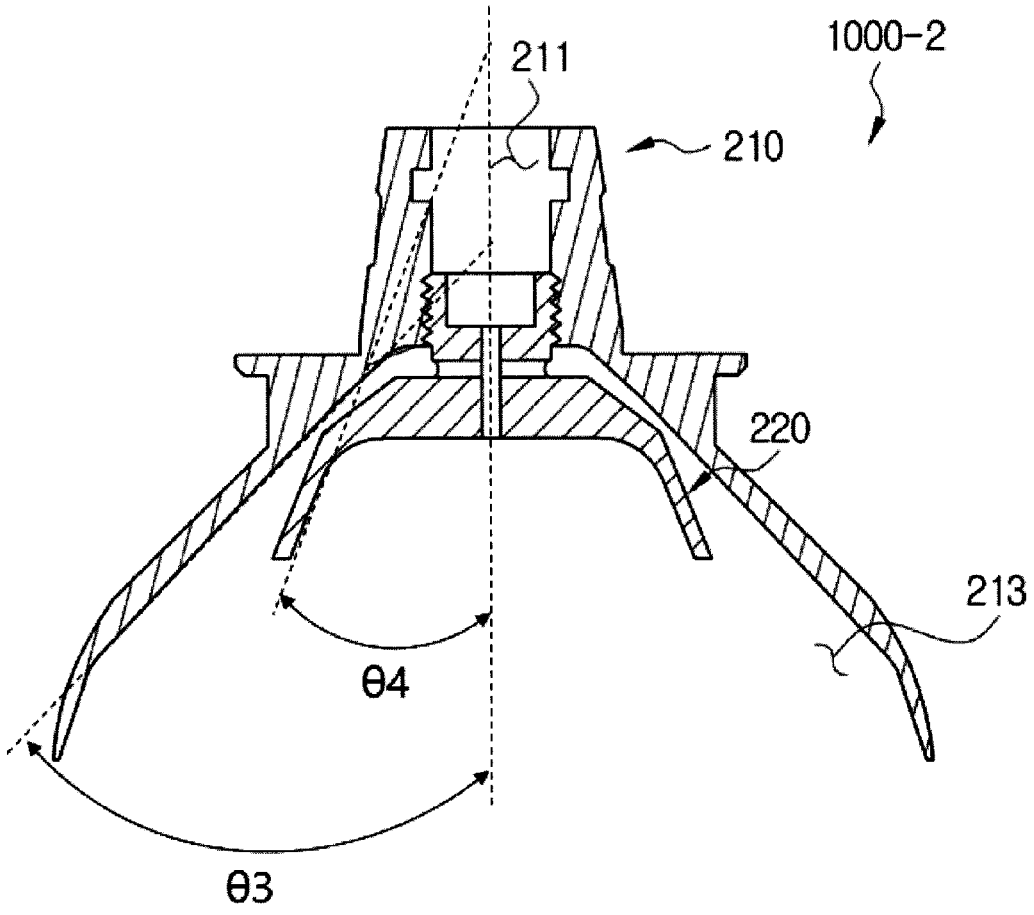

【FIG. 8】
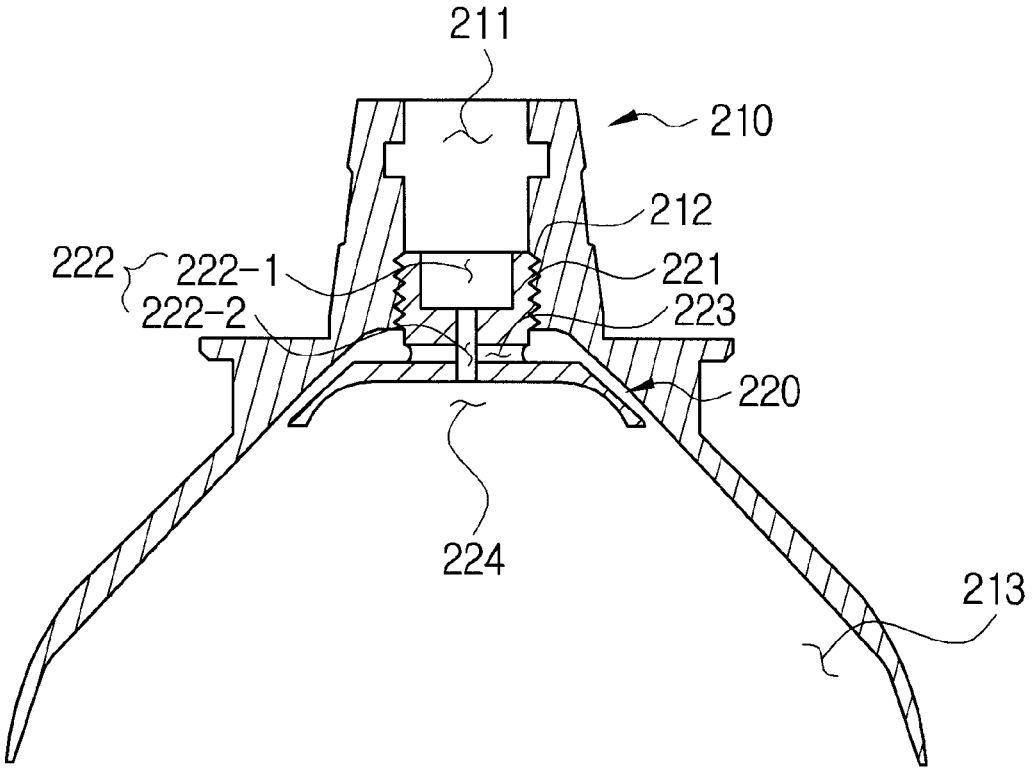

【FIG. 9A】
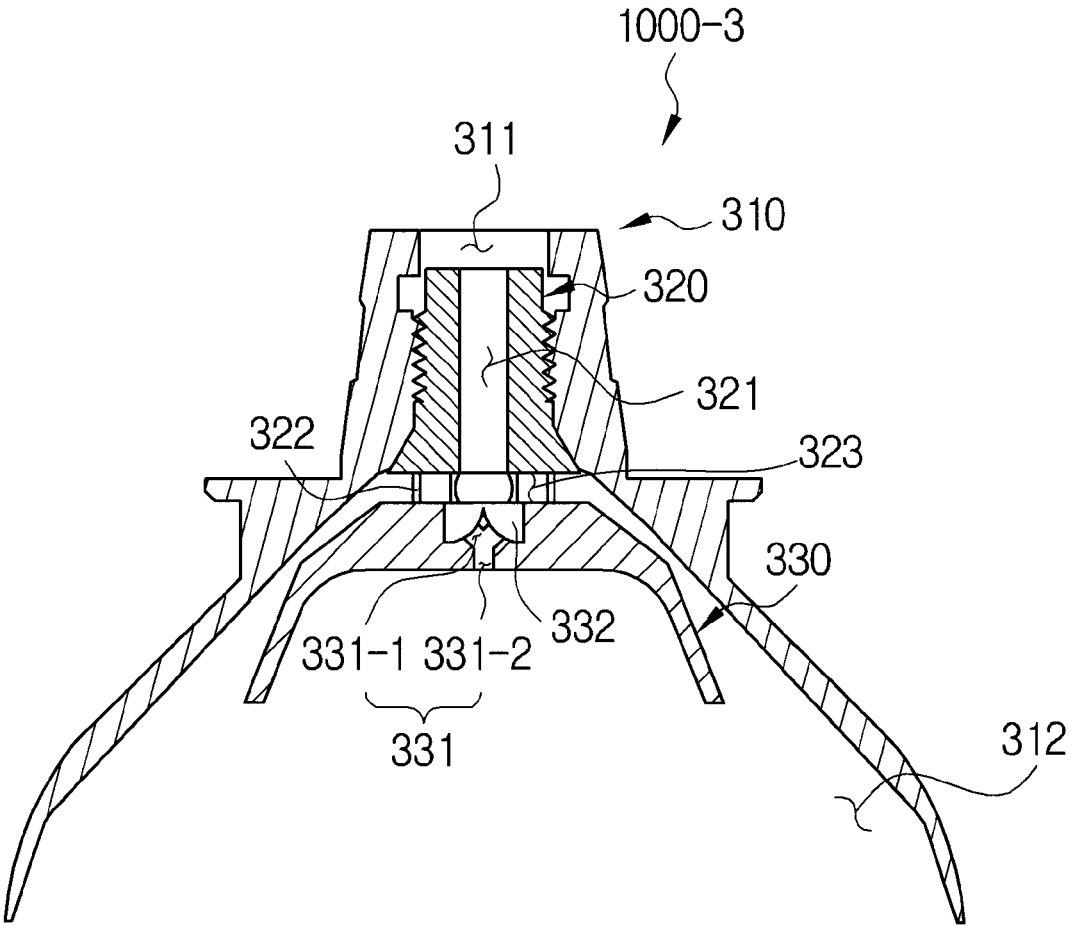

【FIG. 9B】
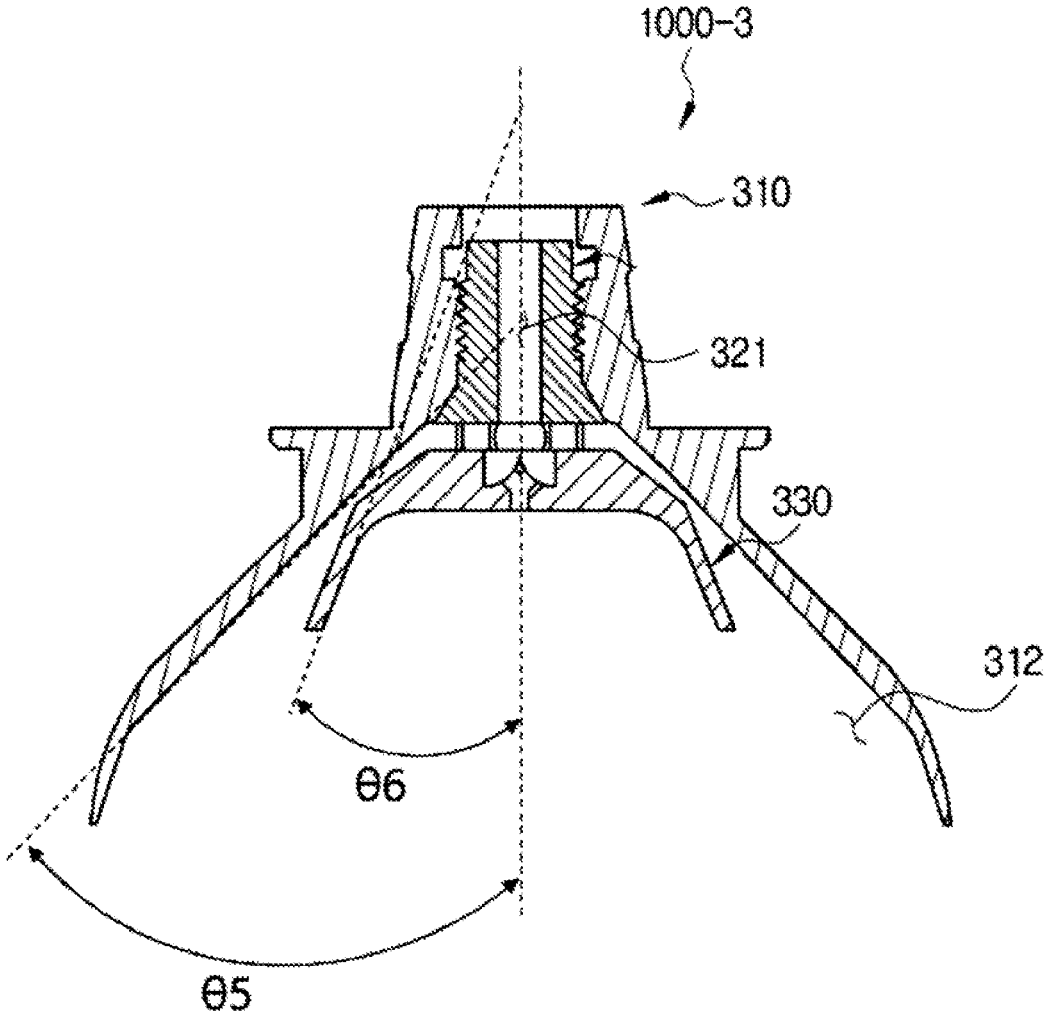

【FIG. 10】
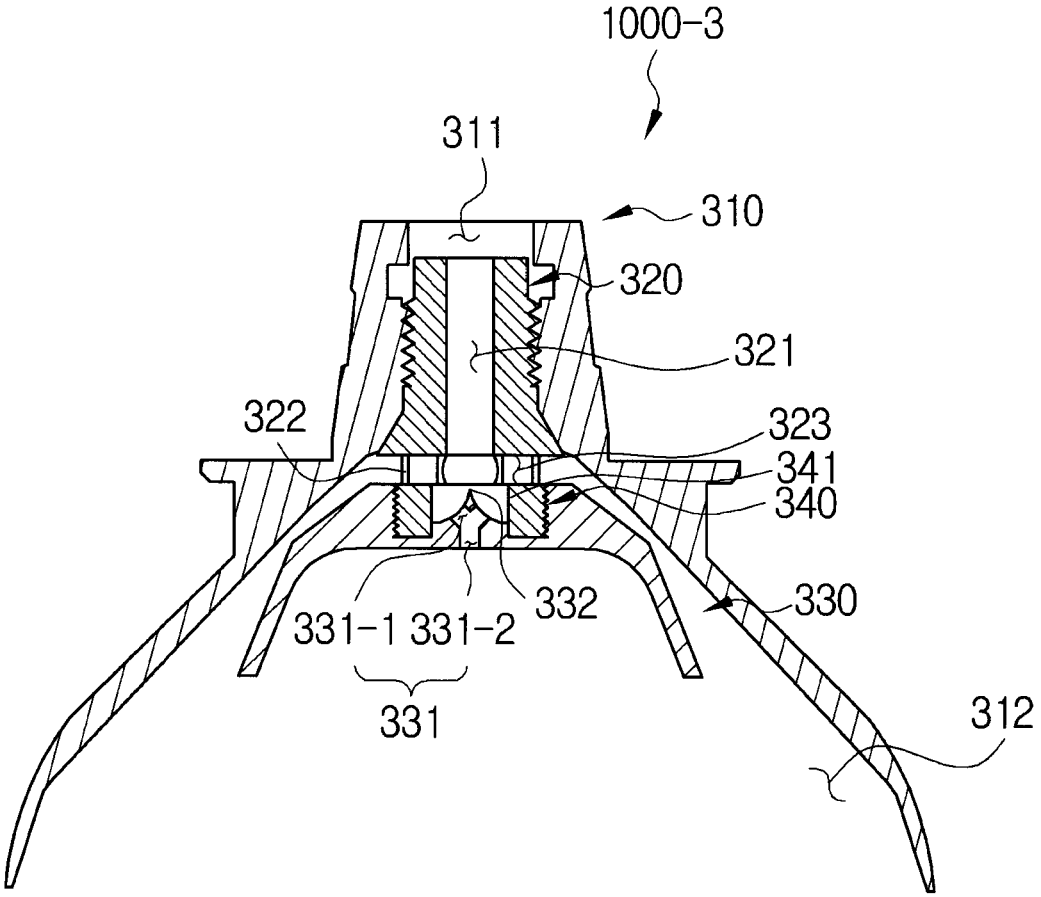

DOUBLE BELL CUP

CROSS-REFERENCE TO RELATED APPLICATIONS

The present application is a U.S. National Phase of International Patent Application Serial No. PCT/KR2016/012958 entitled "DOUBLE BELL CUP," filed on Nov. 11, 2016. International Patent Application Serial No. PCT/KR2016/012958 claims priority to Korean Patent Application No. 10-2016-0007118, filed on Jan. 20, 2016. The entire contents of each of the above-cited applications are hereby incorporated by reference in their entirety for all purposes.

TECHNICAL FIELD

The present invention relates to a bell cup mounted at an end portion of a painting robot and for ejecting a pigment.

BACKGROUND ART

In general, in a vehicle assembly procedure, various components such as a door are assembled on a vehicle body and a painting process of ejecting a pigment to paint internal and external panels with the pigment is lastly performed on such a completely assembled vehicle.

In this case, a device for ejecting a pigment to paint internal and external panels of a vehicle with the pigment is the painting device and an operation thereof is controlled by a controller.

The painting device is installed in a sealed booth and the controller is installed in an external control room isolated from the sealed booth and, in this regard, a worker in the external control room controls an operation of the painting device.

A pigment storage tank, an air tank, and a thinner tank connected to the painting device through a hose are installed in an equipment room isolated from the sealed booth.

FIG. 1 is a schematic diagram showing a conventional painting device.

As shown in FIG. 1, the painting device includes a painting robot 1 including a circulation pipe which is installed therein and in which a pigment is circulated, a driving motor 2 installed at an end portion of the painting robot 1, and a bell cup 3 installed at a driving shaft of the driving motor 2 and configured to centrifugally inject the pigment moved from an ejection pipe to a paint target.

FIG. 2 is a schematic diagram showing a pigment centrifugal-injection state of a conventional bell cup.

As shown in FIG. 2, the conventional bell cup 3 is formed to have a tapered structure that becomes wider from an upper side toward a lower side and includes an inlet hole 31 which is formed at an upper end and through which a pigment moved from the injection pipe is introduced and an injection hole 33 which is formed at a lower end and through which the pigment moved from the inlet hole is injected.

In this case, when the conventional bell cup 3 centrifugally injects a pigment to a paint target, as the pigment introduced into the inlet hole 31 is injected to an outer circumferential region of the injection hole 33 along an inner circumferential surface of the bell cup 3, there is a problem in that the pigment is barely ejected to the center of the injection hole 33 and is insufficiently grain-refined.

In addition, when the conventional bell cup 3 centrifugally injects a pigment to a paint target, as the pigment introduced into the inlet hole 31 is injected only to an outer circumferential region of the injection hole 33 along an inner circumferential surface of the bell cup 3, there is a problem in that a uniform paint film is insufficiently formed at a central portion of the injection hole 33.

Accordingly, the conventional bell cup 3 has a problem in that spraying should be made twice and three times via a redundant and repeated working process during a paint spray operation on the paint target for uniform coating of and there are problems in terms of degradation in color and texture, etc., after paint coating because it is difficult to uniformly coat a paint film composition. In addition, the conventional bell cup 3 has a problem in that a significant amount of pollution and wastes are generated in the equipment due to a high overspray ratio and high costs for pigment and thinner processes, etc., during a redundant spray process requiring two or three applications for acquisition of a uniform paint film of a paint target.

Accordingly, to overcome the aforementioned problems, there has been a need to improve a shape of a bell cup.

As a technology related thereto, Koran Patent Publication No. 2008-0082244 discloses a structure of a separation-type centrifugal spraying bell cup of a painting device installed at a tip end of a painting robot, including a bell body for spraying an ejected pigment, a male spiral which protrudes on the bell body and on which a cover is mounted, a bell cover that is coupled to the male spiral in a separate form to maintain a cover state and at which an outer portion of the bell cup is washed, a cover removal groove disposed on an upper surface of the bell cover to remove or mount the cover, and a female spiral which is coupled to the male spiral and on which the cover is mounted.

DISCLOSURE

Technical Problem

An object of the present invention is to provide a bell cup that simultaneously and centrifugally injects a pigment into a central region and outer circumferential region of the bell cup to enhance color and texture of a paint target, prevents a pigment from being sprayed to be thick to a paint target and prevents a pigment from being coated to be thinner than a reference value to obtain a uniform paint film, and reduces use of a pigment to reduce costs.

Technical Solution

In one general aspect, a double bell cup installed at an end portion of a painting robot to centrifugally inject a pigment to a paint target includes an external body 110 formed to have a tapered structure that becomes wider from an upper side toward a lower side and including a circulation path 111 formed at an upper end of the external body 110 and having a pigment circulated therein, a stagnant path 112 formed inside the external body 110, connected to the circulation path 111, and having a pigment that is stagnant therein, and an injection path 113 formed at a lower end and connected to the stagnant path 112, and an internal body 120 formed to have a tapered structure that becomes wider from an upper side toward a lower side and including a fitting protrusion 121 formed on an outer circumferential surface of an upper end of the internal body 120 and detachably fit to an inner circumferential surface on which the stagnant path 112 of the external body 110 is formed, a center through injection portion 122 formed to penetrate through the center of the internal body 120 in an up and down direction and connected to the stagnant path 112, and an outer circumferential connecting injection portion 123 that connects the stagnant path 112 and the injection path 113 to each other, wherein an external injection angle θ1 of the external body 110 is greater than an internal injection angle θ2 of the internal body 120, an outer diameter of the external body 110 is greater than an outer diameter of the internal body 120, and a pigment stagnant in the stagnant path 112 passes through each of the center through injection portion 122 and the outer circumferential connecting injection portion 123 and is centrifugally injected into a central region and outer circumferential region of the injection path 113.

The center through injection portion 122 may include a plurality of central inlet holes 122-1 that are formed to be spaced apart from each other at a predetermined interval along a circumferential direction on the center of an upper end of the internal body 120, and a central injection hole 122-2 formed at the center of a lower end of the internal body 120 and connected to the central inlet hole 122-1.

The internal body 120 may further include a central inlet guiding protrusion 124 that is formed at an upper end thereof and protrudes toward an upper side on the center of a region in which the plurality of central inlet holes 122-1 is formed.

The outer circumferential connecting injection portion 123 may be a plurality of outer circumferential connection holes 123-1 formed in an outer circumferential surface of the fitting protrusion 121.

The double bell cup may further include external knurling 115 formed by knurling an inner circumferential surface of the lower end of the external body 110 and internal knurling 125 formed by knurling an inner circumferential surface of the lower end of the internal body 120.

The center through injection portion 122 may include a central storage hole 122-5 formed at the center of the upper end of the internal body 120 and a central connection hole 122-6 formed at the center of the lower end of the internal body 120, connected to the central storage hole 122-5, and having a smaller diameter than the central storage hole 122-5.

The outer circumferential connecting injection portion 123 may be a curved flow channel that connects an outer circumferential surface of the central connection hole 122-6 and an outer circumferential surface of the injection path 113 to each other.

In another general aspect, a double bell cup installed at an end portion of a painting robot to centrifugally inject a pigment to a paint target includes an external body 210 formed to have a tapered structure that becomes wider from an upper side toward a lower side and including a circulation path 211 formed at an upper end of the external body 210 and having the pigment circulated therein, a local screw hole 212 formed at the external body 210 and connected to the circulation path 211, and an injection path 213 formed at a lower end of the external body 210 and connected to the local screw hole 212, and an internal body 220 including a socket bolt 221 formed on an outer circumferential surface of an upper end of the internal body 220 and screwed to the local screw hole 212, a center through injection portion 222 formed to penetrate through the center of the socket bolt 221 in a longitudinal direction and connected to the circulation path 211, and an outer circumferential connecting injection portion 223 connecting an outer circumferential surface of the center through injection portion 222 and an outer circumferential surface of the injection path 213 to each other, wherein an external injection angle θ3 of the external body 210 is greater than an internal injection angle θ4 of the internal body 220, an outer diameter of the external body 210 is greater than an outer diameter of the internal body 220, and the pigment circulated in the circulation path 211 passes through each of the center through injection portion 222 and the outer circumferential connecting injection portion 223 and is centrifugally injected into a central region and outer circumferential region of the injection path 213.

The center through injection portion 222 may include a central storage hole 222-1 formed on the center of the upper end of the internal body 220, and a central connection hole 222-2 formed at the center of the lower end of the internal body 220, connected to the central storage hole 222-1, and having a smaller diameter than the central storage hole 222-1.

In another general aspect, a double bell cup installed at an end portion of a painting robot to centrifugally inject a pigment to a paint target includes an external body 210 formed to have a tapered structure that becomes wider from an upper side toward a lower side and including a circulation path 211 formed at an upper end of the external body 210 and having the pigment circulated therein, a local screw hole 212 formed at the external body 210 and connected to the circulation path 211, and an injection path 213 formed at a lower end of the external body 210 and connected to the local screw hole 212, and an internal body 220 including a socket bolt 221 formed on an outer circumferential surface of an upper end of the internal body 220 and screwed to the local screw hole 212, a center through injection portion 222 formed to penetrate through the center of the socket bolt 221 in an up and down direction and connected to the circulation path 211, and an outer circumferential connecting injection portion 223 connecting an outer circumferential surface of the center through injection portion 222 and an outer circumferential surface of the injection path 213 to each other, wherein, when the outer circumferential surface of the internal body 220 is positioned in parallel to an inner circumferential surface of the external body 210, a concave groove 224 is formed by thinning the internal body 220 toward an upper end from a lower end in such a way that an external injection angle of the external body 210 is greater than an internal injection angle of the internal body 220, and the pigment circulated in the circulation path 211 passes through each of the center through injection portion 222 and the outer circumferential connecting injection portion 223 is centrifugally injected into a central region and outer circumferential region of the injection path 213.

In another general aspect, a double bell cup installed at an end portion of a painting robot to centrifugally inject a pigment to a paint target includes an external body 310 formed to have a tapered structure that becomes wider from an upper side toward a lower side and including a front screw hole 311 formed in the external body 310 and an injection path 312 formed on a lower end and connected to the front screw hole 311, a coupling body 320 screwed to the front screw hole 311 and including a coupling path 321 formed to penetrate through the center of the coupling body 320 in an up and down direction and having a pigment circulated therein, and the transmission path 323 formed at a lower end of the coupling body 320 between a plurality of separation protrusions 322 that radially protrude and connecting the coupling path 321 and the injection path 312, and an internal body 330 formed to have a tapered structure that becomes wider from an upper side toward a lower side, having an upper end coupled to a lower end of the plurality of separation protrusions 322, and including a center through injection portion 331 formed to penetrate through the center of the internal body 330 and connected to the coupling path 321, wherein an external injection angle θ5 of the external body 310 is greater than an internal injection angle θ6 of the internal body 330, an outer diameter of the external body 310 is greater than an outer diameter of the internal body 330, and the pigment circulated in the coupling path 321 passes through each of the center through injection portion 331 and the transmission path 323 and is centrifugally injected into a central region and outer circumferential region of the injection path 312.

The center through injection portion 331 may include a plurality of central inlet holes 331-1 spaced apart from each other at a predetermined interval in a circumferential direction in the center of the upper end of the internal body 330 and a central injection hole 331-2 formed at the center of a lower end of the internal body 330 and connected to the central inlet hole 331-1.

The double bell cup may further include an inserted bolt 340 installed between the plurality of separation protrusions 322 and the internal body 330 and including an inserted path 341 for connecting the coupling path 321 and the center through injection portion 331 to each other.

Advantageous Effects

According to the present invention, the double bell cup according to the present invention may simultaneously and centrifugally inject a pigment into a central region and outer circumferential region of the bell cup to enhance color and texture of a paint target, and the conventional problem in terms of increased costs and degradation of painting efficiency because a pigment is non-uniformly coated on a paint target and is painted twice and three times to overlap with each other may be compensated for and overcome.

The double bell cup according to the present invention may be configured in such a way that an internal body and an external may be detachably coupled and, thus, the internal body and the external body may be advantageously and conveniently washed.

DESCRIPTION OF DRAWINGS

FIG. 1 is a schematic diagram showing a conventional painting device.

FIG. 2 is a schematic diagram showing a pigment centrifugal-injection state of a conventional bell cup.

FIG. 3 is a perspective view of a double bell cup according to a first exemplary embodiment of the present invention.

FIGS. 4A and 4B are cross-sectional views showing a flow of a pigment of the double bell cup according to the first exemplary embodiment of the present invention.

FIG. 5 is a perspective view showing another example of the double bell cup according to the first exemplary embodiment of the present invention.

FIG. 6 is a cross-sectional view showing another example of the double bell cup according to the first exemplary embodiment of the present invention.

FIGS. 7A and 7B are cross-sectional views of a double bell cup according to a second exemplary embodiment of the present invention.

FIG. 8 is a cross-sectional view illustrating the case in which an internal body is further concaved in the double bell cup according to the second exemplary embodiment of the present invention.

FIGS. 9A and 9B are cross-sectional views of a double bell cup according to a third exemplary embodiment of the present invention.

FIG. 10 is a cross-sectional view illustrating the case in which an inserted bolt is further included in the double bell cup according to the third exemplary embodiment of the present invention.

BEST MODE

The present invention will now be described more fully with reference to the accompanying drawings, in which exemplary embodiments of the invention are shown.

The accompanying drawings are merely examples shown for explanation of technical features of the present invention and, thus, the technical features are not limited to the accompanying drawings.

With regard to directions of the present invention, an upper side of the drawings is defined as an upper side and a lower side of the drawings is defined as a lower side. A longitudinal direction extends through the center of the external body from the narrower upper side to the wider lower side. The longitudinal direction also extends through the center of the internal body from the narrower upper side to the wider lower side. The longitudinal direction is depicted in FIG. 4B, 7B and 9B. An up and down direction refers to a relative direction from the narrow upper sides of the external and internal bodies to the wider lower sides.

First Exemplary Embodiment

FIG. 3 is a perspective view of a double bell cup according to a first exemplary embodiment of the present invention. FIGS. 4A and 4B are cross-sectional views showing a flow of a pigment of the double bell cup according to the first exemplary embodiment of the present invention. FIG. 5 is a perspective view showing another example of the double bell cup according to the first exemplary embodiment of the present invention.

As shown in FIGS. 3 to 4A, a double bell cup 1000-1 according to the first exemplary embodiment of the present invention may be installed at an end portion of a painting robot to centrifugally inject a pigment to a paint target and may include an external body 110 and an internal body 120. In this case, a driving motor for driving the painting robot may be installed at an end portion of the painting robot and the double bell cup 1000-1 may be installed on the driving motor.

The external body 110 may be formed to have a tapered structure that becomes wider from an upper side toward a lower side and may include a circulation path 111, a stagnant path 112, and an injection path 113 which are each formed therein.

The circulation path 111 may be formed at an upper end of the external body 110 and may have a pigment circulated therein. In this case, the pigment may be supplied from a pigment storage tank that stores the pigment. A screw thread to be coupled to an end portion of the painting robot may be formed on an outer circumferential surface of an upper end of the external body 110.

The stagnant path 112 may be formed in the external body 110 and may be connected to the circulation path 111 and, in this regard, the pigment moved from the circulation path 111 may be temporarily stagnant. In this case, a stagnant projection for inserting a fitting protrusion 121 thereinto may be further formed at a lower end of the stagnant path 112.

The injection path 113 may be formed at a lower end of the external body 110 and may be connected to the stagnant path 112.

The internal body 120 may be formed to have a tapered structure that becomes wider from an upper side toward a lower side and may include the fitting protrusion 121, a center through injection portion 122, and an outer circumferential connecting injection portion 123 which are each formed therein.

The fitting protrusion 121 may be formed on an outer circumferential surface of an upper end of the internal body 120 and may be detachably fit to an inner circumferential surface on which the stagnant path 112 of the external body 110 is formed.

The center through injection portion 122 may be formed to penetrate through the center of the internal body 120 in an up and down direction and may be connected to the stagnant path 112.

The outer circumferential connecting injection portion 123 may be formed between the outer circumferential surface and the inner circumferential surface of the internal body 120 and may connect the stagnant path 112 and the injection path 113 to each other.

Referring to FIG. 4A, the pigment stagnant in the stagnant path 112 may pass through each of the center through injection portion 122 and the outer circumferential connecting injection portion 123 and may be centrifugally injected into a central region and an outer circumferential region of the injection path 113.

In more detail with reference to FIG. 4B, an angle between a central line that connects the center of the external body 110 and the center of the internal body 120 to extend and a line that extends in an up and down direction from an inner circumferential surface of the external body 110 in which the pigment discharged from the stagnant path 112 is moved may be defined as an external injection angle θ1, and an angle between the central line that connects the center of the external body 110 and the center of the internal body 120 and a line that extends in an up and down direction from the inner circumferential surface of the internal body 120 in which the pigment discharged from the stagnant path 112 is moved may be defined as an internal injection angle θ2. In this case, the external injection angle θ1 may be greater than the internal injection angle θ2 and an outer diameter of the external body 110 may be greater than an outer diameter of the internal body 120 and, accordingly, the pigment moved along the internal body 120 may be discharged to an internal section adjacent to the central line and the pigment moved along the external body 110 may be discharged to an external section spaced apart from the central line by a predetermined distance. That is, the pigment stagnant in the stagnant path 112 may pass through the center through injection portion 122 connected to the stagnant path 112, may be centrifugally injected into the central region of the injection path 113 through a central region of the internal body 120, may pass through the outer circumferential connecting injection portion 123 that connects the stagnant path 112 and the injection path 113, and may be centrifugally injected into an outer circumferential region of the injection path 113 along an outer circumferential surface of the injection path 113.

The center through injection portion 122 may include a plurality of central inlet holes 122-1 that are spaced apart from each other at a predetermined interval in a circumferential direction in the center of the upper end of the internal body 120 and a central injection hole 122-2 that is formed at the center of an lower end of the internal body 120 and is connected to the central inlet hole 122-1.

The plurality of central inlet holes 122-1 may radially divide a flow of the pigment moved from the stagnant path 112 and the central injection hole 122-2 may re-collect a flow of the pigment that is radially moved from the plurality of central inlet holes 122-1 to one point and may prevent the pigment from being centrifugally injected along the inner circumferential surface of the internal body 120.

The internal body 120 may further include a central inlet guiding protrusion 124 that is formed on the upper end of the internal body 120 and protrudes toward an upper side on the center of a region in which the plurality of central inlet holes 122-1 is formed.

The central inlet guiding protrusion 124 may guide the pigment moved from the stagnant path 112 to the plurality of central inlet holes 122-1.

That is, the central inlet guiding protrusion 124 may prevent the pigment moved from the stagnant path 112 from being moved to a different point except form the plurality of central inlet holes 122-1.

The outer circumferential connecting injection portion 123 may be a plurality of outer circumferential connection holes 123-1 that are formed in an outer circumferential surface of the fitting protrusion 121. That is, the pigment stagnant in the stagnant path 112 may pass through the plurality of outer circumferential connecting injection portions 123 formed in the outer circumferential surface of the fitting protrusion 121 and may be reached to the outer circumferential surface of the injection path 113.

As shown in FIG. 5, external knurling 115 may be formed by knurling an inner circumferential surface of a lower end of the external body 110 and internal knurling 125 may be formed by knurling an inner circumferential surface of a lower end of the internal body 120.

The external knurling 115 and the internal knurling 125 may disperse the pigment that flows along the inner circumferential surface of the external body 110 and the inner circumferential surface of the internal body 120.

FIG. 6 is a cross-sectional view showing another example of the double bell cup according to the first exemplary embodiment of the present invention.

As shown in FIG. 6, the double bell cup 1000-1 according to the first exemplary embodiment of the present invention may be configured in such a way that the center through injection portion 122 includes a central storage hole 122-5 formed at the center of an upper end of the internal body 120 and a central connection hole 122-6 formed at the center of a lower end of the internal body 120, connected to the central storage hole 122-5, and having a smaller diameter than the central storage hole 122-5.

In this case, the central storage hole 122-5 may store the pigment stagnant in the stagnant path 112 and may guide the pigment to the central connection hole 122-6.

The outer circumferential connecting injection portion 123 may be formed as a curved flow path that connects an outer circumferential surface of the central connection hole 122-6 and an outer circumferential surface of the injection path 113 to each other, may reduce flow velocity of the pigment moved to the outer circumferential surface of the injection path 113 from the outer circumferential surface of the central connection hole 122-6, and may further reduce a flow rate of the pigment moved to the outer circumferential surface of the injection path 113 from the outer circumferential surface of the central connection hole 122-6.

That is, the pigment introduced into the central connection hole 122-6 may pass through the central connection hole 122-6 in an up and down direction, may be centrifugally injected into the central region of the injection path 113 through the center of the internal body 120, and may be centrifugally injected into the outer circumferential region of the injection path 113 along the outer circumferential surface of the injection path 113 while passing through the outer circumferential connecting injection portion 123.

Second Exemplary Embodiment

FIG. 7A is a cross-sectional view of a double bell cup according to a second exemplary embodiment of the present invention.

As shown in FIG. 7A, a double bell cup 1000-2 according to the second exemplary embodiment of the present invention may be installed at an end portion of a painting robot to centrifugally inject a pigment to a paint target and may include an external body 210 and an internal body 220.

The external body 210 may be formed to have a tapered structure that becomes wider from an upper side toward a lower side and may include a circulation path 211, a local screw hole 212, and an injection path 213 which are each formed therein.

The circulation path 211 may be formed at an upper end of the external body 210 and may have a pigment circulated therein.

The local screw hole 212 may be formed in the external body 210 and may be connected to the circulation path 211.

The injection path 213 may be formed at a lower end of the external body 210 and may be connected to the local screw hole 212.

The internal body 220 may include a socket bolt 221, a center through injection portion 222, and an outer circumferential connecting injection portion 223 which are each formed therein.

The socket bolt 221 may be formed on an outer circumferential surface of an upper end of the internal body 220 and may be detachably screwed to the local screw hole 212.

The center through injection portion 222 may be formed to penetrate through the center of the socket bolt 221 in an up and down direction.

The outer circumferential connecting injection portion 223 may connect an outer circumferential surface of the center through injection portion 222 and an outer circumferential surface of the injection path 213 to each other.

The pigment circulated in the circulation path 211 may pass through each of the center through injection portion 222 and the outer circumferential connecting injection portion 223 and may be centrifugally injected into a central region and an outer circumferential region of the injection path 213.

In more detail with reference to FIG. 7B, an angle between a central line that connects the center of the external body 210 and the center of the internal body 220 to extend and a line that extends in an up and down direction from an inner circumferential surface of the external body 210 in which the pigment discharged from the circulation path 211 is moved may be defined as an external injection angle θ3, and an angle between the central line that connects the center of the external body 210 and the center of the internal body 220 and a line that extends in an up and down direction from an inner circumferential surface of the internal body 220 in which the pigment discharged from the circulation path 211 is moved may be defined as an internal injection angle θ4. In this case, the external injection angle θ3 may be greater than the internal injection angle θ4 and an outer diameter of the external body 210 may be greater than an outer diameter of the internal body 220 and, accordingly, the pigment moved along the internal body 220 may be discharged to an internal section adjacent to a central line and the pigment moved along the external body 210 may be discharged to an external section spaced apart from the central line by a predetermined distance. That is, the pigment stagnant in the circulation path 211 may pass through the center through injection portion 222 connected to the circulation path 211, may be centrifugally injected into the central region of the injection path 213 through a central region of the internal body 220, may pass through the outer circumferential connecting injection portion 223 that connects the outer circumferential surface of the center through injection portion 222 and an outer circumferential surface of the injection path 213 to each other, and may be centrifugally injected into an outer circumferential region of the injection path 213 along the outer circumferential surface of the injection path 213.

The center through injection portion 222 may include a central storage hole 222-1 formed at the center of an upper end of the internal body 220, and a central connection hole 222-2 formed at the center of a lower end of the internal body 220, connected to the central storage hole 222-1, and having a smaller diameter than the central storage hole 222-1.

In this case, the central storage hole 222-1 may store the pigment stagnant in a stagnant path and may guide the pigment to the central connection hole 222-2.

FIG. 8 is a cross-sectional view illustrating the case in which the internal body 220 is further concaved in the double bell cup according to the second exemplary embodiment of the present invention. If the height of the internal body 220 is low in such a way that an entire outer circumferential surface of the internal body 220 is formed in parallel to the inner circumferential surface of the external body 210 to centrifugally inject the pigment into the outer circumferential region of the injection path 213, a concave groove 224 may be further formed to allow the pigment to be centrifugally injected into the central region of the injection path 213.

As shown in FIG. 8, when the outer circumferential surface of the internal body 220 is formed in parallel to the inner circumferential surface of the external body 210, the concave groove 224 may be further formed by thinning the internal body 220 toward an upper end from a lower end in such a way that the internal injection angle of the inner circumferential surface of the internal body 220 is smaller than the external injection angle of the external body 210.

In this case, the pigment circulated in the circulation path 211 may be centrifugally injected into the central region of the injection path 213 along an inner circumferential surface of the concave groove 224 of the internal body 220.

Third Exemplary Embodiment

FIG. 9A is a cross-sectional view of a double bell cup according to a third exemplary embodiment of the present invention.

As shown in FIG. 9A, a double bell cup 1000-3 according to the third exemplary embodiment of the present invention may be installed at an end portion of a painting robot to centrifugally inject a pigment to a paint target and may include an external body 310, a coupling body 320, and an internal body 330.

The external body 310 may be formed to have a tapered structure that becomes wider from an upper side toward a lower side and may include a front screw hole 311 and an injection path 312 which are each formed.

The front screw hole 311 may be formed to penetrate through an internal portion of the external body 310 in an up and down direction.

The injection path 312 may be formed at a lower end of the external body 310 and may be connected to the front screw hole 311.

The coupling body 320 may be screwed to the front screw hole 311 and may include a coupling path 321 and a transmission path 323 which are each formed.

The coupling path 321 may be formed to penetrate through the center of the coupling body 320 in an up and down direction and may have a pigment circulated therein.

The transmission path 323 may be formed between a plurality of separation protrusions 322 that radially protrude at a lower end of the coupling body 320 and may connect the coupling path 321 and the injection path 312 to each other.

The internal body 330 may be formed to have a tapered structure that becomes wider from an upper side toward a lower side, may have an upper end coupled to a lower end of the plurality of separation protrusions 322, and may include a center through injection portion 331 formed therein.

The center through injection portion 331 may be formed to penetrate through the center of the internal body 330 and may be connected to the coupling path 321.

In this case, the pigment circulated in the coupling path 321 may pass through the center through injection portion 331 and the transmission path 323 and may be centrifugally injected to a central region and outer circumferential region of the injection path 312.

In more detail with reference to FIG. 9B, an angle between a central line that connects the center of the external body 310 and the center of the internal body 330 to extend and a line that extends in an up and down direction from an inner circumferential surface of the external body 310 in which the pigment discharged from the coupling path 321 is moved may be defined as an external injection angle θ5, and an angle between a central line that connects the center of the external body 310 and the center of the internal body 330 to extend and a line that extends in an up and down direction from an inner circumferential surface of the internal body 330 in which the pigment discharged from the coupling path 321 is moved may be defined as an internal injection angle θ6. In this case, the external injection angle θ5 may be greater than the internal injection angle θ6 and an outer diameter of the external body 310 may be greater than an outer diameter of the internal body 330 and, accordingly, the pigment moved along the internal body 330 may be discharged to an internal section adjacent to the central line and the pigment moved along the external body 310 may be discharged to an external section spaced apart from the central line by a predetermined distance. That is, the pigment circulated in the coupling path 321 may pass through the center through injection portion 331 connected to the coupling path 321, may be centrifugally injected into the central region of the injection path 312 through a central region of the internal body 330, may pass through the transmission path 323, and may be centrifugally injected into the outer circumferential region of the injection path 312 along the outer circumferential surface of the injection path 312.

The center through injection portion 331 may include a plurality of central inlet holes 331-1 that are spaced apart from each other at a predetermined interval in a circumferential direction in the center of an upper end of the internal body 330 and a central injection hole 331-2 that is formed at the center of a lower end of the internal body 330 and is connected to the central inlet hole 331-1.

The plurality of central inlet holes 331-1 may radially divide a flow of the pigment moved from the coupling path 321 and the central injection hole 331-2 may re-collect a flow of the pigment that is radially moved from the plurality of central inlet holes 331-1 to one point and may prevent the pigment from being centrifugally injected along the inner circumferential surface of the internal body 330.

The internal body 330 may further include a central inlet guiding protrusion 332 that is formed on the upper end of the internal body 330 and protrudes on the center of a region in which the plurality of central inlet holes 331-1 is formed.

The central inlet guiding protrusion 332 may guide the pigment moved from the stagnant path to the plurality of central inlet holes 331-1.

FIG. 10 is a cross-sectional view illustrating the case in which an inserted bolt is further included in the double bell cup according to the third exemplary embodiment of the present invention.

As shown in FIG. 10, the double bell cup 1000-3 according to the third exemplary embodiment of the present invention may further include an inserted bolt 340.

The inserted bolt 340 may be installed between the plurality of separation protrusions 322 and the internal body 330 and may include an inserted path 341 that connects the coupling path 321 and the center through injection portion 331 to each other.

That is, the inserted bolt 340 may detachably couple the coupling bolt and the internal body 330.

Even in the double bell cups according to the second and third exemplary embodiments of the present invention, external knurling may be formed by knurling an inner circumferential surface of the lower end of the external body and internal knurling may be formed by knurling an inner circumferential surface of the lower end of the internal body.

Accordingly, the double bell cup according to the present invention may simultaneously and centrifugally inject a pigment into a central region and outer circumferential region of the bell cup to enhance color and texture of a paint target, and the conventional problem in terms of increased costs and degradation of painting efficiency because a pigment is non-uniformly coated on a paint target and is painted two or three times to overlap with each other may be compensated for and overcome.

The double bell cup according to the present invention may be configured in such a way that an internal body and an external body may be detachably coupled and, thus, the internal body and the external body may be advantageously and conveniently washed.

The present invention is not limited to the abovementioned exemplary embodiments, but may be variously applied. In addition, the present invention may be variously modified by those skilled in the art to which the present invention pertains without departing from the gist of the present invention claimed in the claims.

DETAILED DESCRIPTION OF MAIN ELEMENTS

1000-1: double bell cup according to the first exemplary embodiment of the present invention
110: external body
111: circulation path
112: stagnant path
113: injection path
115: external knurling
120: internal body
121: fitting protrusion
122: center through injection portion
122-1: central inlet hole
122-2: central injection hole

122-5: central storage hole
122-6: central connection hole
123: outer circumferential connecting injection portion
123-1: outer circumferential connection hole
122-5: central storage hole
124: central inlet guiding protrusion
125: internal knurling
1000-2: double bell cup according to the second exemplary embodiment of the present invention
210: external body
211: circulation path
212: local screw hole
213: injection path
220: internal body
221: socket bolt
222: center through injection portion
222-1: central storage hole
222-2: central connection hole
223: outer circumferential connecting injection portion
224: concave groove
1000-3: double bell cup according to the third exemplary embodiment of the present invention
310: external body
311: front screw hole
312: injection path
320: coupling body
321: coupling path
322: separation protrusion
323: transmission path
330: internal body
331: center through injection portion
331-1: central inlet hole
331-2: central injection hole
332: central inlet guiding protrusion
340: inserted bolt
341: inserted path
θ1, θ3, and θ5: external injection angle
θ2, θ4, and θ6: internal injection angle

The invention claimed is:

1. A double bell cup installed at an end portion of a painting robot to centrifugally inject a pigment to a paint target, comprising:

an external body formed to have a tapered structure that becomes wider from an upper side toward a lower side and including a circulation path formed at an upper end of the external body and having a pigment circulated therein, a stagnant path formed inside the external body, connected to the circulation path, and having a pigment that is stagnant therein, and an injection path formed at a lower end and connected to the stagnant path; and an internal body formed to have a tapered structure that becomes wider from an upper side toward a lower side and including a fitting protrusion formed on an outer circumferential surface of an upper end of the internal body and detachably fit to an inner circumferential surface on which the stagnant path of the external body is formed, a center through injection portion formed to penetrate through the center of the internal body in a longitudinal direction and connected to the stagnant path, and an outer circumferential connecting injection portion that connects the stagnant path and the injection path to each other, wherein an external injection angle of the external body is greater than an internal injection angle of the internal body, an outer diameter of the external body is greater than an outer diameter of the internal body, and a pigment stagnant in the stagnant path passes through each of the center through injection portion and the outer circumferential connecting injection portion and is centrifugally injected into a central region and outer circumferential region of the injection path, wherein the external body extends past the internal body in a direction of the injection path.

2. The double bell cup of claim 1, wherein the center through injection portion includes a plurality of central inlet holes that are formed to be spaced apart from each other at a predetermined interval along a circumferential direction on the center of an upper end of the internal body, and a central injection hole formed at the center of a lower end of the internal body and connected to the central inlet hole.

3. The double bell cup of claim 2, wherein the internal body further includes a central inlet guiding protrusion that is formed at an upper end thereof and protrudes toward an upper side on the center of a region in which the plurality of central inlet holes is formed.

4. The double bell cup of claim 2, wherein the outer circumferential connecting injection portion is a plurality of outer circumferential connection holes formed in an outer circumferential surface of the fitting protrusion.

5. The double bell cup of claim 1, further comprising external knurling formed by knurling an inner circumferential surface of the lower end of the external body and internal knurling formed by knurling an inner circumferential surface of the lower end of the internal body.

6. The double bell cup of claim 1, wherein the center through injection portion includes a central storage hole formed at the center of the upper end of the internal body and a central connection hole formed at the center of the lower end of the internal body, connected to the central storage hole, and having a smaller diameter than the central storage hole.

7. The double bell cup of claim 6, wherein the outer circumferential connecting injection portion is a curved flow channel that connects an outer circumferential surface of the central connection hole and an outer circumferential surface of the injection path to each other.

8. The double bell cup of claim 1, wherein the external body extends further than the internal body in a direction of the circulation path.

9. The double bell cup of claim 1, wherein the external body is the external body of the double bell cup, and wherein the internal body is the internal body of the double bell cup.

* * * * *